United States Patent [19]

Hillberg

[11] 4,441,448

[45] Apr. 10, 1984

[54] CONTROLLED MOORING

[76] Inventor: Ernest T. Hillberg, 1721 Sheffield Dr., La Habra, Calif. 90631

[21] Appl. No.: 172,279

[22] Filed: Jul. 25, 1980

[51] Int. Cl.[3] ..... B63B 21/00

[52] U.S. Cl. ..... 114/230

[58] Field of Search ..... 114/230, 242–254, 114/220; 9/8 P; 141/387; 441/3

[56] References Cited

U.S. PATENT DOCUMENTS

| | | | |
|---|---|---|---|
| 2,715,314 | 8/1955 | Smith | 114/230 |
| 3,155,069 | 11/1964 | Ross et al. | 114/230 |
| 3,257,986 | 6/1966 | Glosten | 114/250 |
| 3,354,479 | 11/1967 | Koppenol et al. | 114/230 |
| 3,442,245 | 5/1969 | Christians et al. | 114/230 |
| 3,572,408 | 3/1971 | Hnot | 141/387 |
| 3,585,958 | 6/1971 | Neczkowski | 114/220 |
| 3,585,959 | 6/1971 | Cook | 114/220 |
| 3,830,186 | 8/1974 | Janssen et al. | 114/249 |
| 3,863,590 | 2/1975 | Karl et al. | 9/8 P |
| 3,964,423 | 6/1976 | Gassett et al. | 9/8 P |
| 3,999,498 | 12/1976 | Flory | 114/230 |
| 4,007,599 | 2/1977 | Brown | 9/8 P |
| 4,010,500 | 3/1977 | Reid, Jr. | 9/8 P |
| 4,029,039 | 6/1977 | van Heijst | 9/8 P |
| 4,031,582 | 6/1977 | Van Heijst | 9/8 P |
| 4,055,136 | 10/1977 | Fujisawa et al. | 114/251 |
| 4,114,556 | 9/1978 | Orndorff et al. | 114/230 |
| 4,119,051 | 10/1978 | Orndorff | 114/249 |
| 4,176,615 | 12/1979 | Reid et al. | 114/230 |
| 4,193,368 | 3/1980 | De Graaf et al. | 9/8 P |

FOREIGN PATENT DOCUMENTS

| | | | |
|---|---|---|---|
| 1554881 | 10/1979 | United Kingdom | 114/230 |
| 2019800 | 11/1979 | United Kingdom | 114/230 |

*Primary Examiner*—Trygve M. Blix
*Assistant Examiner*—Jesús D. Sotelo
*Attorney, Agent, or Firm*—Gausewitz, Carr, Rothenberg & Edwards

[57] ABSTRACT

A floating vessel is moored to a floating facility, a fixed dock or another floating vessel by a pair of rigid compressive links pivotally connected to each other and to the two facilities that are to be moored to each other. A partly submerged spar buoy is pivotally connected to the two rigid links at their pivotal connection to each other and, by virtue of its weight and buoyancy, provides a restraining force acting through the rigid links that tends to maintain the distance between the two interconnected facilities.

25 Claims, 12 Drawing Figures

FIG. 2.
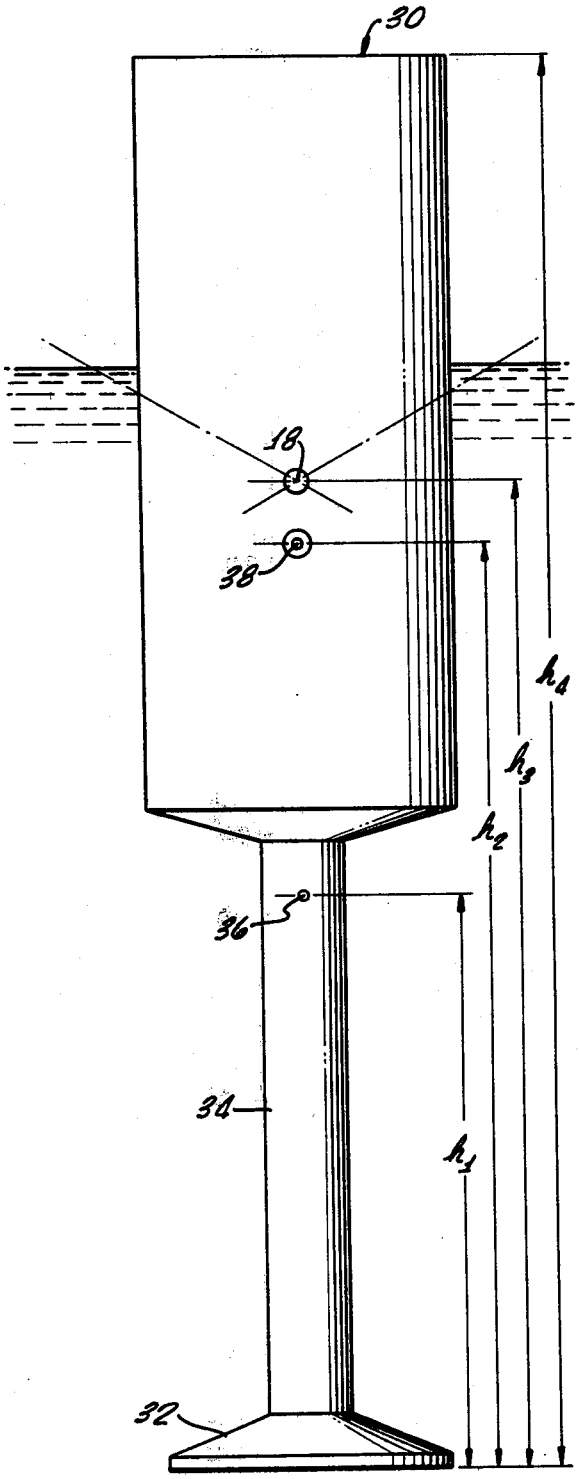
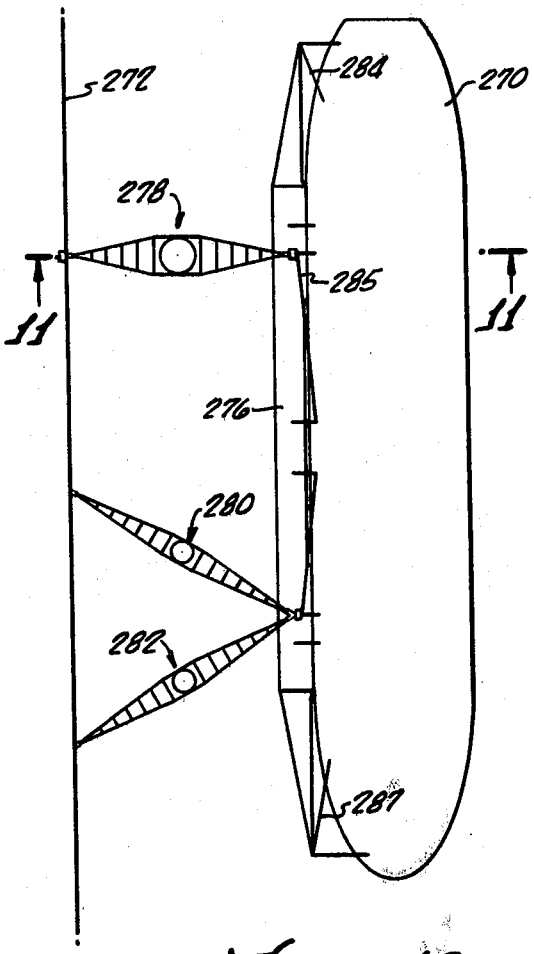
FIG. 10.
FIG. 11.
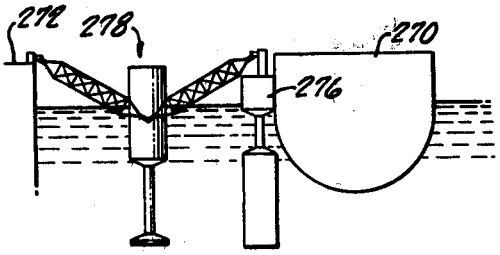

FIG. 5.
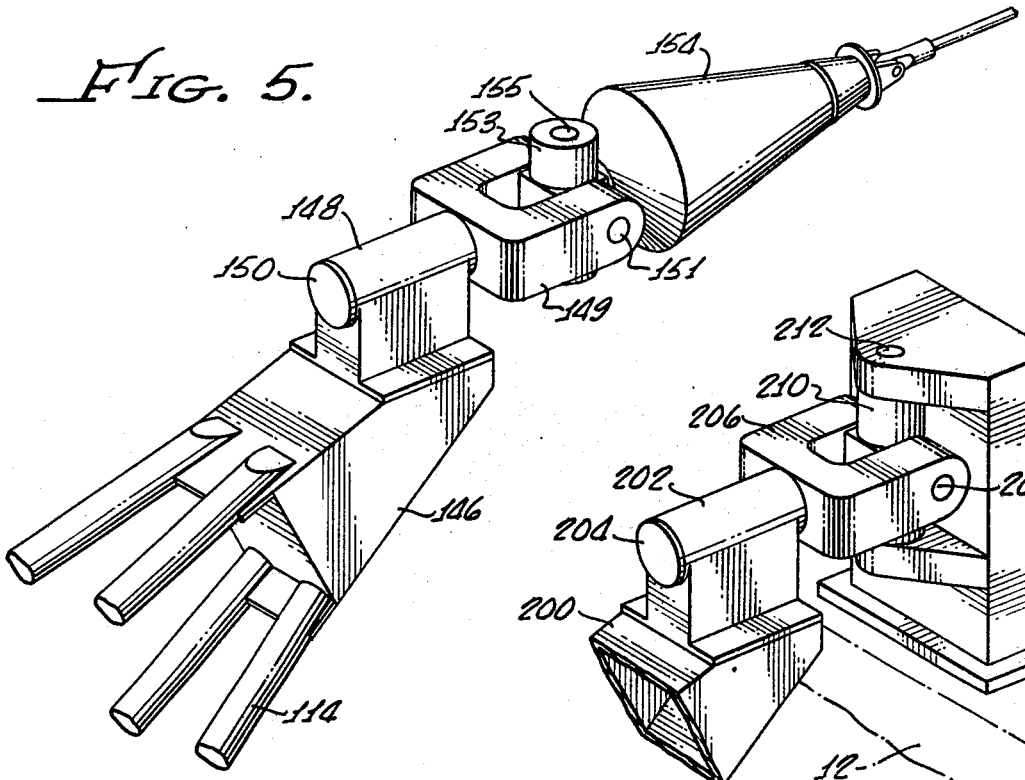
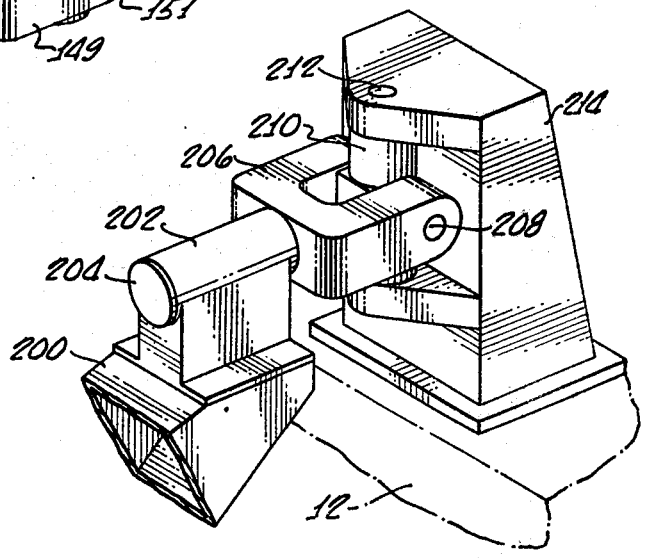
FIG. 6.
FIG. 12.
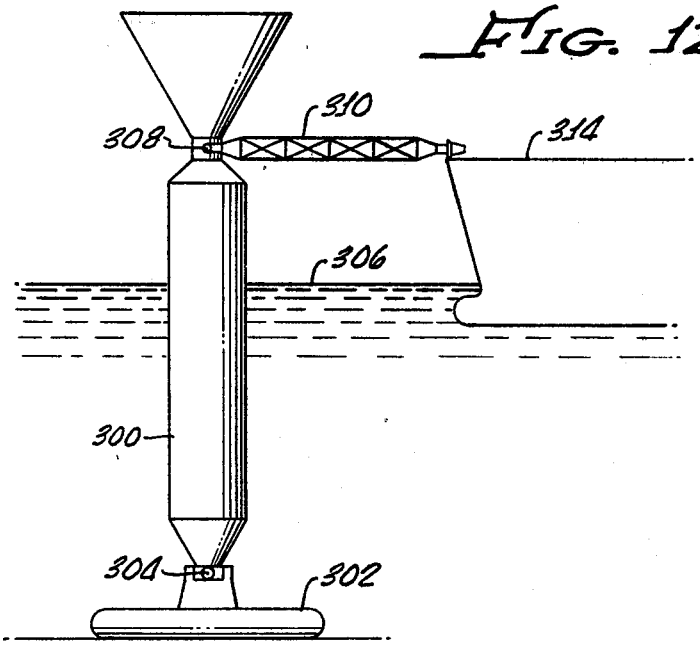

CONTROLLED MOORING

BACKGROUND OF THE INVENTION

The present invention relates to mooring systems and more particularly concerns a mooring system that provides positive controlled restraint of the position of a moored facility.

In an offshore receiving terminal adapted to receive cargo from a transporting vessel and to transfer the received cargo to onshore facilities, the transport vessel must be moored to the terminal during cargo transfer and must be maintained in position and restrained relative to the terminal facility to allow connection and operation of cargo transfer piping systems and the like. Similar open sea mooring of a vessel is employed at surface facilities above underwater oil/gas producing wells and at other floating terminal or storage facilities. Such mooring systems presently use groups of hausers interconnecting the vessel to anchors or other devices at the ocean bottom. Single point mooring systems have been provided in the form of rigid towers anchored or pivoted to the ocean bottom and rising above the water surface for connection with a vessel which thus may at times be free to swing in a full circle about the mooring point.

Flexible hausers provide insufficient restraint, particularly in storms and highly disturbed sea states. Many such flexible mooring lines are required for control of position of the moored vessel and all must be connected and disconnected. Rigid connections to a moored vessel are only possible between the vessel and a movable system, such as a floating buoy of the type shown, for example, in U.S. Pat. No. 4,148,107 for Mooring Buoy. In such an arrangement, controlled position of the moored vessel depends upon control of the position of the buoy and this, in turn, is positioned by hausers such as flexible chains of a conventional mooring system. Conventional single point mooring terminals and single anchor leg mooring systems such as shown in U.S. Pat. No. 4,042,990 for Single Point Mooring Terminal and U.S. Pat. No. 3,979,785 for Combined Catenary And Single Anchor Leg Mooring System provide restrained and generally buoyant mooring terminals but these, again, are connected to the vessel to be moored by means of flexible lines which provide inadequate control of the moored vessel in high sea states. When sea forces become too great, many of these systems require disconnection of the vessel from the mooring to avoid damage.

Similar but aggravated problems are presented in the docking of vessels to a relatively fixed offshore floating facility where various combinations of flexible tensioned lines and interposed resilient bumpers and the like have been suggested. These also prove inadequate in the presence of highly disturbed sea states.

Accordingly, it is an object of the present invention to provide mooring methods and systems that minimize or eliminate above-mentioned problems.

SUMMARY OF THE INVENTION

In carrying out principles of the present invention in accordance with a preferred embodiment thereof, first and second compression links are pivotally connected to each other at one end of each and the other ends of the two links are respectively pivoted to the mooring facility and to the vessel to be moored. A partly submerged buoy is pivoted to the links adjacent their pivotal interconnection with each other.

BRIEF DESCRIPTION OF THE DRAWINGS

FIG. 2 illustrates an exemplary configuration of a buoy employed in the system of FIG. 1, FIG. 5 illustrates a portion of a modification of the coupling of FIGS. 3 and 4, FIG. 6 shows another modified coupling portion, FIG. 7 schematically illustrates the mooring of a vessel to a floating terminal, FIG. 8 schematically illustrates application of principles of the present invention to the interconnection of separate facilities of an offshore industrial complex, FIGS. 10 and 11 illustrate the use of controlled mooring systems of the present invention for the docking of a vessel, and FIG. 12 shows a mooring system employing a single anchor leg mooring.

DETAILED DESCRIPTION

Figure 1:
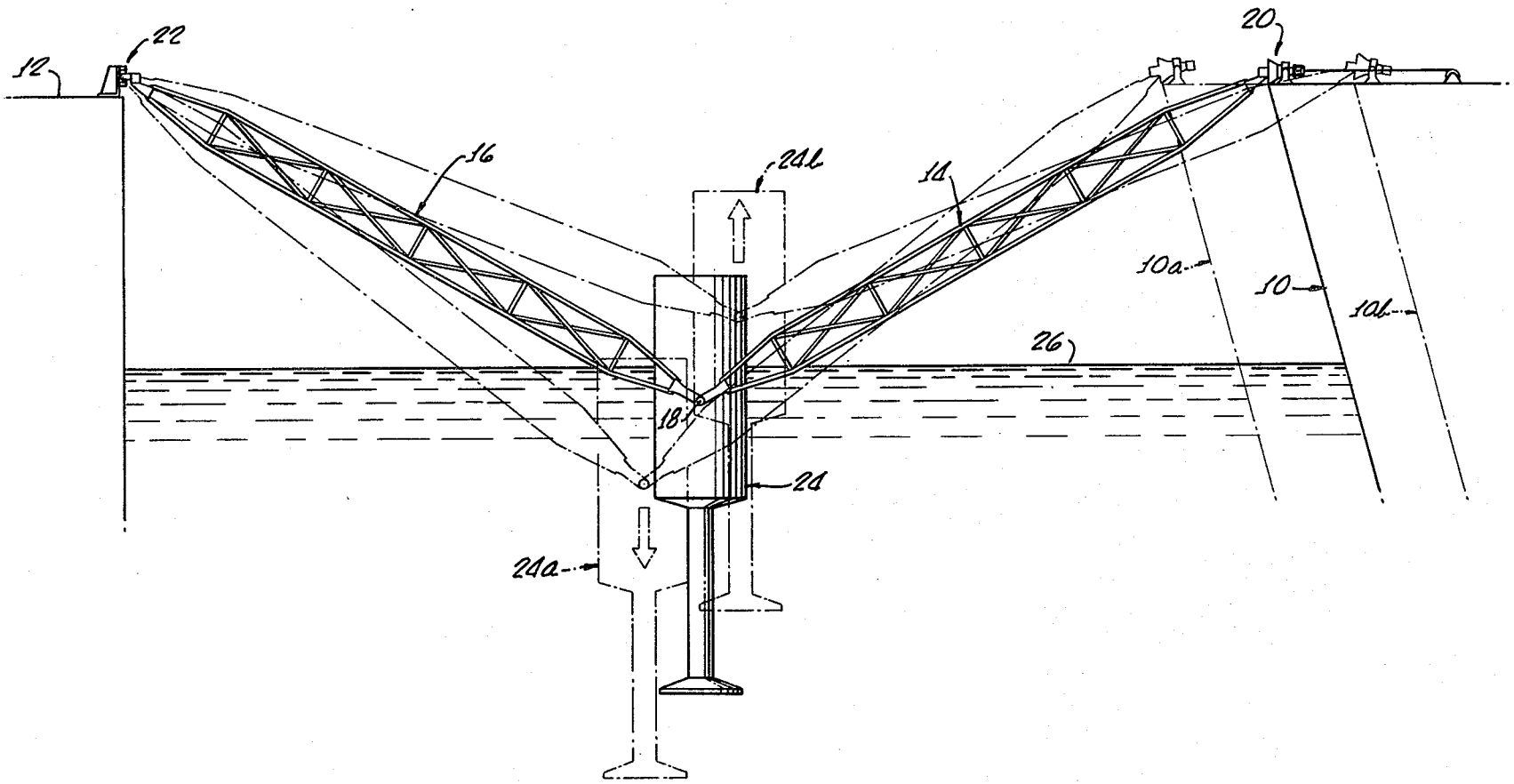
FIG. 1 illustrates portions of a pair of objects interconnected by a controlled mooring system embodying principles of the present invention.

Illustrated in FIG. 1 is an arrangement embodying principles of the present invention for mooring a sea going vessel 10 (only a portion of which is illustrated) to an offshore mooring terminal or facility 12 (of which only a portion is illustrated). Facility 12 may be fixed or floating as will be described below. The vessel and facility are connected to one another by a controlled mooring link embodying principles of the present invention. First and second inextensible compression links in the form of rigid three-dimensional trusses 14 and 16 are pivotally connected to each other about a generally horizontally directed pivot axis 18. Preferably, the compression links 14,16 are of mutually equal length and are made with suitable configuration and transverse dimensions to resist transverse bending in all directions. The remote ends of the two links are pivotally connected to the vessel 10 and the mooring facility 12 by coupling devices 20,22, respectively, each of which provides three degrees of pivotal motion.

A vertically elongated, partly submerged buoy 24 is pivotally connected to mutually interconnected ends of the links 14,16 on the pivot axis 18 whereby, in a static condition, the buoy will be partly submerged below the surface 26 of the body of water in which the vessel 10 floats.

As illustrated in FIG. 2, an exemplary buoy configuration includes a hollow cylindrical shell 30 providing most of the buoyancy of the buoy and a substantially horizontally extending damping plate 32 rigidly interconnected to the bottom of the shell 30 by means of a rigid column 34. In the illustrated exemplary arrangement, the center of gravity of the buoy is positioned at point 36, the center of buoyancy at point 38 and the pivotal connection of the pivot axis 18 of the two links to each other and to the buoy is positioned above the center of gravity and the center of buoyancy 38 of the buoy.

Pivot point 18 is offset from a line between the pivotal connections 20 and 22 of the remote ends of the links and thus, the two links are mutually oblique or inclined relative to one another. To avoid a "dead center" condition, any possible alignment of the links with each other must be a momentary or unstable condition. The geometry of the mooring system is arranged so that even in the presence of the most highly disturbed sea state expected to be encountered, the oblique relation remains. Thus, although the pivot point 18 may approach the line between connections 20 and 22, the chosen geometry avoids a condition of alignment of the three pivot points.

In the normal or steady state position illustrated in solid lines in FIG. 1, the buoy submerges to a distance at which its buoyancy is equal to and balances the combined weight of the buoy and that portion of the weight of the two links 14,16 which is supported by the buoy. As the buoy moves vertically in the water, its buoyancy changes, but the weight of the buoy and the weight of those portions of the links supported by the buoy remains substantially constant, except for the change in supported link weight components caused by the change in inclination of the links. Thus, changes in the distance between vessel 10 and facility 12 are resisted by changes of appropriate sense in the buoyancy of the buoy.

As the moored vessel 10 approaches the facility 12, it moves to a position such as shown at 10*a*, and the rigid links 14 and 16 experience axial compressive forces having horizontal and vertical components acting through the pivotal connection at point 18 with the buoy 24. The horizontal components are balanced against each other and the vertical components add to each other. This provides a net downward force on the buoy, which accordingly moves to a position such as illustrated by the dash lines 24*a*. Thus, the submergence of the buoy 24 is increased from its steady state submergence by the compressive forces in the links 14,16 and accordingly, the upward buoyant force exerted by the now more deeply submerged buoy upon the pivot 18 concomitantly increases. An upward buoyant force exerted on the pivot 18 is transmitted axially of the compression links to the coupling connections 20 and 22. Thus the increased submergence of the buoy, caused by approach of the vessel 10 to the facility 12 causes an increased buoyant force that tends to move the vessel further away from the facility 12.

Similarly, should the displacement between vessel 10 and facility 12 be increased from the normal steady state displacement illustrated in solid lines in FIG. 1, so that the vessel 10 moves to a dotted line position illustrated at 10*b*, an upward force is exerted by the links upon the buoy, which thus moves upwardly to the position illustrated in dotted lines and designated at 24*b* in FIG. 1. As submergence of the buoy decreases to the position illustrated at 24*b*, the upward buoyant force exerted by the buoy likewise decreases and accordingly, the net force exerted by the buoy is downward since weight of the buoy itself, together with part of the weight of the links 14,16 is now greater than the buoyancy. Thus a gravity produced force is exerted downwardly upon the pivot axis 18 and tends to decrease the displacement between the vessel 10 and facility 12.

Since the links are rigid, the distances (as measured along the links) between the pivot axis 18 and the coupling points 20 and 22 respectively, that is, the distances along the inclined axes of the links, remain fixed, while the buoy is permitted freedom of vertical motion relative to the vessel 10 and facility 12. The links move toward mutual alignment as the vessel moves away from the facility and toward increased oblique relation as the vessel approaches the facility. These motions are resisted by the concomitantly changing displacement of the buoy. Where the links are of equal length and symmetrically positioned relative to the buoy, the latter will move horizontally half of the change in horizontal distance between the vessel and facility.

The amount of resistive force applied by the buoy is determined by the water plane area of the buoy, the slope of the links and the weight of links and buoy. The resistive force exerted by the buoy, resisting change in relative displacement between the vessel 10 and facility 12, acts very much like the force of a double-acting or bi-directional spring having a spring rate that varies with a change in length. This effective spring rate of the mooring system can be varied to suit particular applications. The effective spring rate can be linear or can be provided with various degrees of nonlinearity. Variation of the spring rate is readily achieved by changing the horizontal cross section of the buoy (the water plane area) as a function of the vertical distance along that portion of the buoy that crosses the water surface during the vertical motion of the buoy. For example, to increase the rate at which the resistive force increases as the vessel approaches the facility 12, the buoy would be made with a configuration such that its water plane area increases with increased submergence. This variation of water plane area with variation of buoy submergence may be continuous or discontinuous, linear or nonlinear.

In a presently preferred embodiment the pivot axis 18 that interconnects the links 14,16 is coincident with the pivotal connection between the links and the buoy and intersects a line drawn between the center of buoyancy of the buoy and its center of gravity. In this manner, forces exerted upon and by the buoy are more readily constrained to act axially of the buoy and through its center of gravity and overturning or tilting forces on the buoy are minimized. Nevertheless, it is contemplated that the two links can be pivotally connected to the buoy at points spaced horizontally along the buoy. In such an arrangement, it is more important for the axes of the links to intersect at a point between the center of gravity and the center of buoyancy of the buoy in order to minimize possible tilting or overturning moments on the buoy. Where the pivot axes at which the links are connected to each other and to the buoy are all coincident as illustrated in FIG. 1, the common pivot axis may be positioned above the center of buoyancy.

It will be readily appreciated that other buoyant arrangements may be employed at or near the pivotal interconnection of the links 14,16 to provide the described vertically directed resistive forces that oppose change in relative displacement of the vessel and facility. For example, instead of using a single buoy pivotally connected to the links 14,16 at their pivotally interconnected ends, two separate buoys may be employed, one connected, by pivotal or non-pivotal means, to link 14 at a point spaced from its pivotal connection 18 to the link 16, and a second similarly connected to link 16 at a point spaced from pivotal connection 18. In such an arrangement all three connections are preferably pivotal, including a pivot axis between the two links and pivot axes between the two buoys and the respective links, and all such axes are mutually parallel and all generally horizontal.

It will be readily appreciated that the magnitude of the positive position control exerted by the described system may be readily varied by varying the size, weight and buoyancy of the buoy and also by varying the angle of inclination of the compression links. For example, an increase in the rate of increase of buoyancy with increased submergence will provide greater rate of increase of resistive forces and accordingly will provide more closely controlled position of the moored vessel.

For mooring of an 80,000 ton vessel, for example, buoy 24 will have a displacement of approximately four hundred and thirteen tons and, in an exemplary configuration, will be about twenty-two feet in diameter. Distances $h_1$, $h_2$, $h_3$, and $h_4$, from the bottom of the buoy to the center of gravity, center of buoyancy, link pivot, and buoy top, respectively, are about thirty-four feet, fifty-four feet, seventy feet and one hundred feet respectively, the length of shell 30 being fifty-five feet and the length of column 34 being forty feet. As a very rough measure, the buoy is designed to have a displacement of about one-half of one percent of the displacement of the smallest vessel to be moored thereby.

Desirably, large ships are moored with a separation in the order of about three hundred feet. Smaller ships, in the order of 6,000 tons or less, might be moored with a separation of less than seventy-five to one hundred feet. For a separation of approximately three hundred feet each link has a length of slightly more than one hundred fifty feet.

In a presently preferred embodiment, the truss structure of each link is preferably formed of hollow pipe which may be, for example, twelve inches in diameter and sealed at its ends, whereby at least one link will float. Preferably, at least one of the couplings 20,22 is detachable so that the floating link, such as link 14, will lie in the water ready to be picked up and connected to a vessel as it comes into its mooring.

Figure 3:
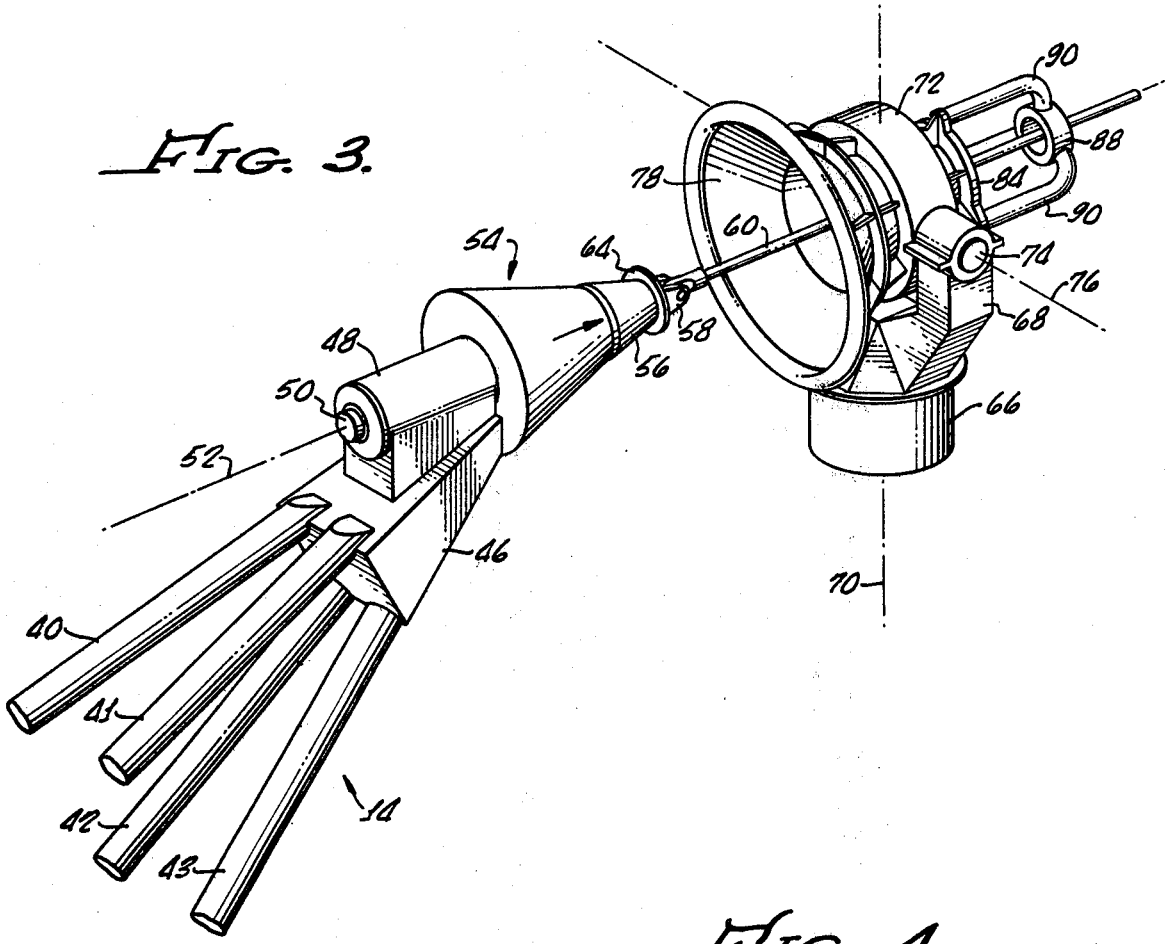
FIG. 3 is a pictorial illustration of a coupling for connecting one end of a compression link to a mooring facility on a vessel.
Figure 4:
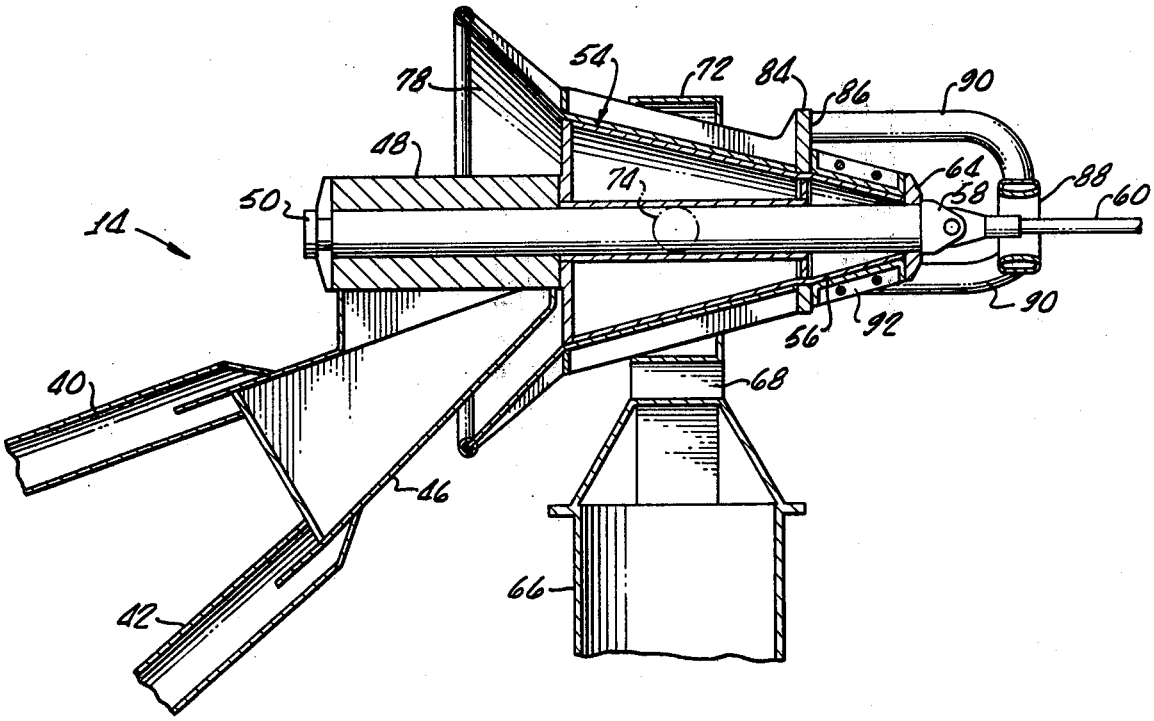
FIG. 4 is a sectional view of the coupling of FIG. 3.

Although many detachable multi-axis mooring coupling connections may be employed in the practice of this invention, FIGS. 3 and 4 illustrate a three degree of freedom coupling presently preferred. As shown in FIG. 3, structural elements 40, 41, 42 and 43 of the free end of truss structure making up link 14 are fixedly connected to an end block 46 carrying a bearing sleeve 48 that rotatably mounts a pivot pin 50 extending along a first pivot axis 52. The axis 52 of pin 50, which is the roll axis of the detachable connection, is angulated relative to the longitudinal extent of the link 14 by an amount that allows this roll axis to be substantially horizontal in a normal steady state geometry of the controlled link mooring system, when the link 14 is connected to a moored vessel. Fixed to the pin 50 for rotation relative to block 46 about axis 52 is a conical stabber 54 having diverging bearing surfaces provided by its conical outer surface which diverges from a forward end 56. Upon this stabber end is mounted a clevis and pin arrangement 58 connected to an in-haul cable 60. Fixed to the smaller end of stabber 54 inwardly of the clevis is a radially outwardly projecting circular flange 64 that provides a locking surface for purposes to be described below.

A second part of the coupling connection is mounted on the floating vessel by means of a fixed supporting pedestal 66 that is fixedly connected to the vessel. A yoke 68 is pivotally mounted to the pedestal 66 for rotation about a vertical (yaw) axis 70 and a receiving head body 72 is pivoted to and between the arms of yoke 68 on a pivot pin 74 for motion about a third (pitch) axis 76. The receiving head comprises a cone shaped aperture having a diverging conical bearing surface 78 adapted to mate with and bear upon the congruent conical bearing surface of stabber 54. An inboard end of the receiving head carries a rigid, radially outwardly projecting flange 84 with a rearwardly facing bearing or locking surface 86. An in-haul cable guide 88 connected to and projecting rearwardly of the receiving head body by a plurality of legs 90 is apertured to receive and guide the in-haul cable 60.

A detachable keeper 92 formed of a plurality of conical segments circumscribes the smaller forward end of the stabber 54, being interposed between and bearing upon locking surfaces of the two circular flanges, flange 84 of the receiving head and flange 64 of the stabber, to prevent withdrawal of the stabber from the receiving head. The segments of the keeper are fitted around the stabber after the latter is seated in the receiving head, and are then bolted together.

Illustrated in FIG. 5 is an alternate stabber in which all three degrees of freedom are provided on the stabber coupling part. Such an arrangement is adapted for use with a conical receiving head (not shown) which may be fixedly mounted to the vessel to be moored. In the arrangement of FIG. 5, conical stabber body 154 is connected to a block 146 at the end of link 114 with three degrees of pivotal freedom. Stabber 154 is pivotally connected to a roll axis pin 150 carried in a bearing sleeve 148 on body 146. Pin 150 is fixed to a first yoke 149 that is pivoted on a pin 151 (pitch axis) to a sleeve 153 that is pivotally connected to the stabber body for motion about an axis (yaw) 155. The remainder of this stabber and the manner of its connection, attachment and detachment to and from the vessel mounted receiving head (not shown) are substantially the same as for the previously described stabbing head. Such a vessel mounted receiving head is substantially identical to that shown in FIGS. 3 and 4 except that the structure providing yaw and pitch axes is replaced by fixedly connected parts.

Illustrated in FIG. 6 is an exemplary three degree of freedom pivotal connection between the end 200 of link 16 and the mooring facility 12. This three degree of freedom coupling need not be detachable since the link 16 may be permanently connected to the fixed facility. The connection of FIG. 6 is similar to the three degree of freedom pivotal connection shown with respect to the stabber of FIG. 5 and includes a sleeve block 202 in which is journalled a roll axis pin 204 fixed to a yoke 206 that carries a pitch axis pin 208. Pin 208 pivotally carries a sleeve 210 that is pivoted upon yaw axis pin 212 that is journalled in a pair of spaced ears of a coupling block 214 fixedly connected to the mooring terminal 12.

In operation of the described mooring system, link 16 is permanently secured by the described pivotal connections to and between the mooring terminal and the buoy. The remote end of link 14, that end which carries the stabber 54, is free of connection to any vessel and, accordingly, the link 14 floats on the surface of the water. In-haul line 60 which is connected to the stabber 54 as described has attached thereto a streamer and float (not shown). A vessel to be moored approaches the stabber float to cross the streamer at a slight angle. The streamer is retrieved by a hook or line handling boat and passed through the receiving head and receiving head guide 88 to a suitable winch on the approaching vessel. At this time, the forward speed of the vessel is zero or nearly zero. The in-haul line is pulled in by a power winch while the mooring vessel is under a slow reverse drive to maintain tension in the in-haul line 60 and thus assist in guiding the stabber to initial contact to and within the divergent aperture of the receiving head. The mating conical surfaces center the stabber and enable it to extend through the receiving head whereupon the segments of keeper 92 are placed about the forward end of the stabber and bolted together to securely lock the stabber to and within the receiving head. The reverse procedure is carried out to disconnect the mooring system from the moored vessel.

Figure 7:
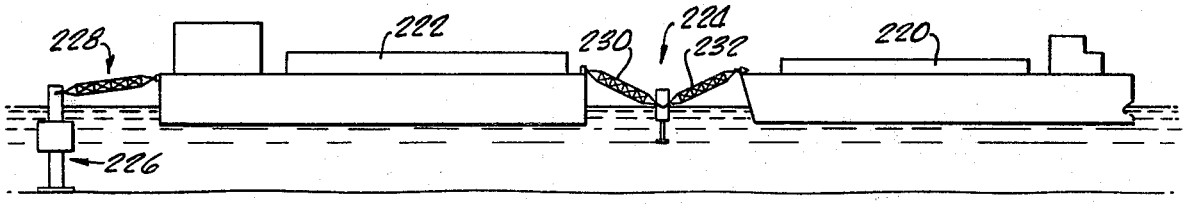

It will be readily appreciated that the described mooring system may be employed for the interconnection of a number of different types of objects in the open sea or other locations subject to highly disturbed sea states. For example, as illustrated in FIG. 7, a vessel 220 is moored to a floating terminal 222 by means of a controlled mooring link 224 of the type previously described. The floating terminal 222 is coupled to a single point mooring system or single anchor leg mooring 226 by a mooring connection generally illustrated at 228.

A significant advantage derived from the rigidity of the compression links 230,232 employed in the controlled mooring link 224 is the fact that the links provide a relatively solid articulated connecting bridge between the moored vessel and the mooring terminal. Connecting links 14 and 16 have known relative motions and configurations and thus one may employ hard (relatively non-flexible) cargo transfer pipes permanently positioned upon the mooring links and permanently connected to the floating terminal and which may be readily connected and disconnected to the transport vessel 220. Such rigid transfer pipes provide improved environmental durability and other advantages. For example, a flexible hose is more likely to break suddenly without warning whereas a rigid pipe will often leak before it breaks, thus providing a warning of deteriorated condition.

Figure 8:
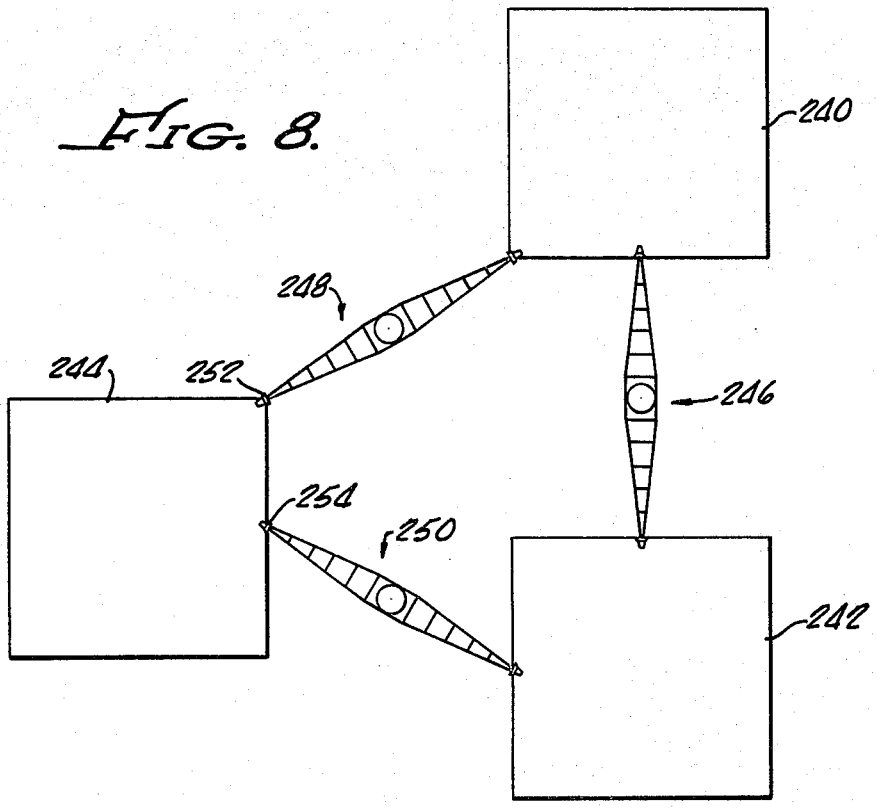

Illustrated in FIG. 8 is an arrangement using several controlled mooring links of the type described herein for interconnecting a plurality of floating facilities that may collectively provide a floating or offshore industrial complex. For example, in an offshore mining operation, a floating facility 240 may provide power generation. A floating facility 242 may provide living and personnel quarters and a floating facility 244 may provide refining of ore mined from the ocean bottom. Facilities 240 and 242 are connected to each other by a controlled mooring link 246 of the type illustrated in FIG. 1. Floating facility 244 is connected to each of facilities 240 and 242 by similar controlled mooring links 248 and 250. The connections of controlled mooring systems 248 and 250 to the facility 244 are at points 252 and 254, which are spaced apart on the facility 244. Thus the azimuth orientation of floating facility 244 is controlled relative to the facilities 240 and 244. Similarly, the mutually spaced points of connection of the two controlled mooring systems to each of the other two facilities provide for azimuth orientation of these facilities and thus the several facilities are not only fixedly positioned relative to one another (within the constraints of the described controlled mooring systems) but are also fixedly oriented relative to one another.

Figure 9:
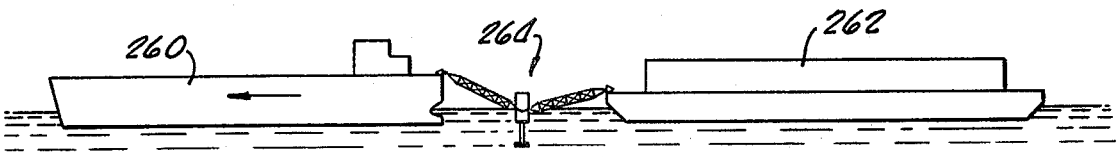
FIG. 9 illustrates the controlled mooring system of the present invention employed for towing.

In certain ocean mining systems, a mining vessel 260 shown in FIG. 9 will tow a storage or transfer barge 262 as the mining vessel slowly moves along the surface, mining the bottom as it goes and towing the storage barge 262. The latter may be connected to the towing vessel 260 by a controlled mooring system 264 of the type previously described, thereby avoiding the possibility that the towed barge may advance to a position undesirably close to or in contact with the towing vessel. Furthermore, the rigid articulated linkage interconnecting the two vessels provides convenient support for cargo transfer pipes, conveyors and the like. It will be understood that in all the systems described herein the rigid articulated links of the described mooring system greatly facilitate communication across the mooring system and the positioning and support of apparatus for transfer of personnel and materials.

A system of the type illustrated in FIGS. 10 and 11 may be employed for offshore docking of a vessel 270 to an offshore terminal or facility 272. As previously described, the use of two or more of the described articulated controlled mooring links may be employed to provide greater precision of position control and also to provide orientation control. Such connection of plural systems of the type described herein may be made directly to a floating vessel or facility as previously mentioned in connection with FIG. 8. Alternatively, as illustrated in FIGS. 10 and 11, a horizontally elongated rigid floating platform 276 is moored to the terminal 272 by a plurality of controlled mooring links of the type described herein. Three of such mooring links are illustrated and designated at 278, 280 and 282 in FIG. 10. It is preferred to use three or more of such controlled mooring links for maximum control of position and orientation of larger vessels. Preferably, as illustrated in FIG. 10, the several controlled mooring links are angularly disposed relative to one another. For example, controlled mooring link 278 extends substantially perpendicular to the lengths of the mutually parallel floating platform 276 and the facing side of facility 272. Controlled mooring links 280 and 282, on the other hand, each extends at a different angle (as measured in a horizontal plane) relative to one another and to the float and facility. This provides not only orientation control but control of both longitudinal and transverse displacement of the floating platform 276 relative to the facility 272. In use of the system illustrated in FIGS. 10 and 11, the floating platform 276 is permanently moored to the facility 272 by the illustrated group of controlled mooring links and the transfer vessel 270 is caused to dock alongside the platform 276 in a conventional fashion, being tightly coupled to the floating platform 276 by conventional mooring lines, schematically indicated at 284, 285, 286 and 287. Thus, a secondary mooring facility, in form of platform 276, is moored to a primary mooring facility 272 in a manner so as to provide a controlled and restrained motion of the secondary facility even in highly disturbed sea states. This enables docking of the transfer vessel to the secondary mooring facility without the use of or limitations of conventional resilient buffering and cushioning systems.

The various configurations of the controlled mooring system described above employ rigid links extending from a buoyant body upwardly from the water surface. As pointed out above, these links are mutually oblique. It is also contemplated to employ principles of the present invention for mooring of a transport vessel to a point fixed below the surface of the water. In such an arrangement a subsurface facility, in the form of a suitable construction or fixed apparatus mounted rigidly on the ocean bottom, may comprise one connecting point of the two link rigid system. In such an arrangement, one link will extend from a pivotal connection at the bottom fixed structure to a pivotal connection with the second rigid link near the water surface. The second link in turn is arranged for detachable three degree of freedom pivotal connection to the transport vessel. In such an arrangement it may be convenient to provide the variable buoyancy controlled resistive force in the underwater arm itself, as shown in FIG. 12. In this embodiment a first arm of an articulated linkage of a controlled mooring system is in the form of a substantially vertically extending elongated buoyant body 300 that is pivotally connected to a bottom fixed structure 302 at a gimbal connection 304 that provides for two degrees of pivotal motion, about two mutually orthogonal horizontal axes of the body 300, relative to the bottom structure 302. Buoyant body 300 extends upwardly above the water surface 306 to a pivotal connection at 308 to an inextensible compression link 310 that may be substantially identical to either of links 14,16 described above. Link 310 is connected at point 308 to the body 300 for pivotal motion about a horizontal axis that is perpendicular to the axial extent of link 310. Link 310 is also connected to the body 300 for rotation about the vertical axis of the body so that the link 310 may rotate three hundred sixty degrees about the buoyant body 300. The outboard, or remote, end of link 310 carries a detachable pivotal coupling of the type illustrated in FIGS. 3 and 4. Thus, the free end of link 310 carries a conical stabber pivoted to the end of the link about an axis lying substantially along (at a small angle to) the length of the link. The stabber is adapted to be connected to a receiving head of the type shown in FIGS. 3 and 4 that is mounted upon a vessel to be moored to the illustrated system. The receiving head as previously described is arranged with two degrees of pivotal motion so that the coupling between the outboard end of link 310 and the vessel 314 has three degrees of pivotal freedom. This arrangement provides three degrees of rotational freedom of the moored vessel 314 relative to the mooring link and facilitates coupling and uncoupling of the vessel to and from the buoyant link. It also allows the vessel 314 to rotate three hundred sixty degrees about the buoyant body 300 and buoyantly resists both approach to and displacement from the normal or steady state and undisturbed position of the buoyant body 300. Should the vessel tend to approach the mooring point, the body 300 will tilt toward the left as viewed in FIG. 12. As it tilts its buoyancy increases providing an inceasing force tending to restore the buoyant body 300 to its normal vertical position, thus resisting the motion of the vessel 314. Similarly, should the vessel tend to move away from the buoyant body, toward the right as viewed in FIG. 12, the buoyant body tilts in the other direction about its pivotal connection adjacent the ocean bottom at point 304 whereby its buoyancy again increases to provide a resistive buoyant force tending to right the body 300 and draw the vessel 314 back to its nominal and displaced position. The two axis pivotal connection at 304 permits this action with any orientation of the vessel and link 310 about the link 300.

In the manner previously described in connection with other embodiments of the present invention the outboard end of rigid compression link 310 may be disconnected from the vessel and the free end of the link may then be lowered to the surface of the water where it buoyantly remains for pick up by another transport vessel that is to be moored to the bottom structure 302. The arrangement illustrated in FIG. 12 provides a simplified pivotal connection at point 308 between rigid arm 310 and the buoyant body 300 requiring only a freedom of motion about a single horizontal axis and about a vertical axis. Nevertheless, positive constraint of the transient transport vessel 314 is provided and as previously described, the rigid link 310 provides a ready and convenient support on which may be permanently mounted cargo transfer pipes and the like. Where the buoyant body 300 is connected to the ocean bottom offshore, the cargo transfer pipes carried on the fixed arm 310 may extend as a permanent cargo transport installation between the body 300 and shore based facilities.

If deemed necessary or desirable, the connection between the buoy and one or both of links 14,16 may be provided with an additional pivot axis, affording pivotal freedom in roll.

There have been described methods and apparatus of mooring a floating vessel or interconnecting floating facilities by a rigid articulated linkage that affords positive and controlled restraint of relative position and orientation.

The foregoing detailed description is to be clearly understood as given by way of illustration and example only, the spirit and scope of this invention being limited solely by the appended claims.

What is claimed is:

1. A controlled restraint system for mooring a floating vessel to a mooring terminal, said system comprising a partly submerged buoy, control means for varying submergence of said buoy to significantly change its buoyancy and for causing said change in buoyancy to resist movement of said vessel toward or away from said terminal, said control means comprising a first substantially inextensible compression link pivotally connected to and between said buoy and said terminal, and a second substantially inextensible compression link pivotally connected at one end to said buoy about an axis parallel to the axis of the pivotal connection between said buoy and said first link and adapted to be movably connected at its other end to said vessel in oblique relation to said first link, said links being connected to said buoy so as to displace said buoy further into or out of the water and significantly change its buoyancy when said vessel moves to or from said terminal, whereby such change in buoyancy effectively restrains said movement of said vessel.

2. The system of claim 1 wherein said terminal has a portion extending above the water surface and wherein said first link is connected to said terminal at said portion.

3. The system of claim 1 wherein said first link is connected to said terminal with three degrees of freedom.

4. The system of claim 1 wherein both said links are connected to said buoy adjacent the center of buoyancy of said buoy.

5. The system of claim 1 wherein said first link is inclined upwardly from said buoy to the terminal whereby approach of a vessel connected to said second link urges said buoy vertically to change its displacement and whereby such approach is resisted by the changed displacement of said buoy.

6. The system of claim 5 wherein said first link inclines upwardly from said buoy and wherein said buoy is vertically elongated and is connected to said link so as to minimize tilting moments on the buoy.

7. The system of claim 5 wherein said second link is rigid and buoyant and includes means at the end thereof remote from said buoy for detachable connection to said vessel.

8. The system of claim 7 wherein said means for detachable connection comprises means for permitting pivotal motion of said second link relative to said vessel about at least two mutually angulated axes.

9. The system of claim 1 wherein the pivot connection between said first link and said buoy is a connection having a generally horizontal pivot axis and wherein the pivotal connection between said second link and said buoy is a connection having a normally horizontal pivot axis adjacent said first mentioned axis.

10. The system of claim 9 wherein said axes are coincident.

11. The system of claim 10 wherein said axes are between the centers of buoyancy and gravity of said buoy.

12. The system of claim 1 wherein said links are pivotally connected to said buoy above the center of gravity thereof.

13. The system of claim 1 wherein said links are pivoted to said buoy at a common axis intersecting a line between the centers of buoyancy and gravity thereof.

14. The system of claim 1 including coupling means for detachably connecting said second link to said vessel, said coupling means comprising a tapered stabber having bearing surfaces diverging in a first direction from one end thereof, means for mounting said stabber to said second link for pivotal motion about an axis extending in said direction, a receiving head having diverging bearing surfaces receiving and mating with said stabber bearing surfaces, means for mounting said receiving head to a vessel to be moored to said terminal, and means for locking said stabber to said receiving head.

15. A controlled restraint mooring system comprising an articulated arm having first and second mutually oblique compression links pivoted to each other for relative motion about a normally horizontal axis, means for pivotally connecting remote ends of said links respectively to first and second objects, and buoyancy means pivotally connected to both said links on said normally horizontal axis so as to decrease tilting and effect vertical displacement of said buoyancy means in response to relative motion of said objects toward or away from one another.

16. The system of claim 15 wherein said buoyancy means comprises a bouyant body pivotally connected to said links at a point offset from a line between said pivotally connected remote ends of said links, said body having a cross-section that causes a change in the rate of change of buoyancy with a change in submergence of the body.

17. A system for coupling an object floating upon a body of water to another object comprising a partly submerged buoy floating in the water between said objects, coupling means for interconnecting said objects and said buoy, said coupling means comprising means responsive to variation of the distance between said objects in one sense or the other for changing the amount of buoy submergence so as to minimize tilting and overturning moments on said buoy, said means for changing the amount of buoy submergence also being responsive to change in buoy submergence for resisting variation of the distance between said objects, said means for changing the amount of buoy submergence comprising first and second mutually oblique compression links pivotally connected to and between said buoy and respective ones of said objects, said links being pivoted to said buoy on mutually coincident substantially horizontal axes that intersect a line between the centers of buoyancy and gravity of said buoy.

18. A system for coupling an object floating upon a body of water to another object comprising a partly submerged buoy floating in the water between said objects, coupling means for interconnecting said objects and said buoy, said coupling means comprising means responsive to variation of the distance between said objects in one sense or the other for changing the amount of buoy submergence so as to minimize tilting and overturning moments on said buoy, said means for changing the amount of buoy submergence also being responsive to change in buoy submergence for resisting variation of the distance between said objects, wherein said objects are first and second floating facilities, and including a third floating facility, second and third coupling means and buoys each substantially similar to said first mentioned coupling means and buoy for interconnecting said third facility to each of said first and second facilities.

19. A method of towing a first vessel from a second vessel comprising connecting a pair of pivotally interconnected compression links to and between said vessels, and pivotally connecting a partly submerged buoy to said links between said vessels so as to cause said buoy to increase its submergence when said vessels approach one another and to cause said buoy to decrease its submergence when the distance between said vessels increases.

20. The method of providing a controlled restraint coupling between a vessel floating at the surface of a body of water and an object near said surface, said method comprising floating a partly submerged buoy between said vessel and object, downwardly displacing said buoy so as to minimize its tilting and to increase its submergence as said vessel approaches said object to thereby increase the buoyancy of said buoy, employing said increased buoyancy to resist said approach of said vessel, upwardly displacing said buoy so as to minimize its tilting and to decrease its submergence as said vessel moves away from said object to thereby decrease buoyancy of said buoy, and employing the decreased buoyancy of said buoy to resist said motion of the vessel away from said object.

21. A system for coupling a towed vessel floating upon a body of water to a towing vessel comprising a partly submerged buoy floating in the water between said towed and towing vessels, coupling means for interconnecting said towed and towing vessels and said buoy, said coupling means comprising means responsive to variation of the distance between said vessels in one sense or the other for changing the amount of buoy submergence, and said means for changing the amount of buoy submergence also being responsive to change in buoy submergence for resisting variation of the distance between said vessels, said coupling means for interconnecting said vessels comprising first and second mutually oblique compression links pivotally connected to and between said buoy and respective ones of said towed and towing vessels.

22. A mooring coupling for connecting first and second objects comprising a tapered stabber having bearing surfaces diverging in a first direction from one end thereof, means for mounting said stabber to said first object for pivotal motion about an axis extending in said direction, a receiving head having diverging bearing surfaces receiving and mating with said stabber bearing surfaces, means for mounting said receiving head to said second object, means for locking said stabber to said receiving head, wherein said means for locking comprises means for providing a first transversely extending locking surface on said stabber, means for providing a second transversely extending locking surface on said receiving head between said stabber locking surface and the other end of said stabber, and keeper means interposed between said locking surfaces for preventing withdrawal of said stabber from said receiving head, including an in-haul cable connected to said stabber and an in-haul cable guide connected to and projecting rearwardly of said receiving head, said receiving head being axially apertured to allow said cable to pass therethrough.

23. A controlled restraint system for mooring a floating vessel to a mooring terminal, said system comprising a partly submerged vertically elongated buoy having a center of buoyancy, a first downwardly inclined link pivotally connected to said terminal with three degrees of freedom and pivotally connected to said buoy about a substantially horizontal axis adjacent said center of buoyancy, a second downwardly inclined link pivotally connected to said vessel with three degrees of freedom and pivoted to said buoy about said axis, said axis intersecting a line between the centers of buoyancy and gravity of said buoy, whereby as said vessel approaches said mooring terminal said links increase submergence of said buoy with minimized tilting movements and increased buoyancy of the buoy resists such approach, and whereby as said vessel moves away from said terminal said links decrease submergence of said buoy with minimized tilting movements and decreased buoyancy of the buoy resists such movement.

24. The system of claim 23 wherein both said links are pivoted to said buoy at a point not higher than said center of buoyancy.

25. The system of claim 23 wherein said links are pivoted to said buoy on a common pivot axis.

* * * * *

UNITED STATES PATENT AND TRADEMARK OFFICE

CERTIFICATE OF CORRECTION

PATENT NO. : 4,441,448

DATED : April 10, 1984

INVENTOR(S) : Ernest T. Hillberg

It is certified that error appears in the above-identified patent and that said Letters Patent are hereby corrected as shown below:

In claim 23 (column 14, line 27), "movements" should read ---moments---.

In claim 23 (column 14, line 31), "movements" should read ---moments---.

Signed and Sealed this

*Second* Day of *October 1984*

[SEAL]

*Attest:*

GERALD J. MOSSINGHOFF

*Attesting Officer*

*Commissioner of Patents and Trademarks*